US009903373B2

(12) United States Patent
Hawes et al.

(10) Patent No.: US 9,903,373 B2
(45) Date of Patent: Feb. 27, 2018

(54) DUAL MOTOR DRIVE FOR ELECTRIC SUBMERSIBLE PUMP SYSTEMS

(71) Applicant: GENERAL ELECTRIC COMPANY, Schenectady, NY (US)

(72) Inventors: Nathaniel Benedict Hawes, Ballston Spa, NY (US); Kum Kang Huh, Schenectady, NY (US); David Allen Torrey, Ballston Spa, NY (US); Di Pan, Schenectady, NY (US); Tomas Sadilek, Schenectady, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 267 days.

(21) Appl. No.: 14/946,513

(22) Filed: Nov. 19, 2015

(65) Prior Publication Data

US 2017/0146015 A1 May 25, 2017

(51) Int. Cl.
*F04D 15/00* (2006.01)
*F04D 13/08* (2006.01)
(Continued)

(52) U.S. Cl.
CPC ..... *F04D 15/0066* (2013.01); *E21B 43/128* (2013.01); *F04D 13/08* (2013.01);
(Continued)

(58) Field of Classification Search
CPC ..... F04D 15/0066; F04D 13/08; F04D 13/10; F04D 47/06; F04B 49/06; F04B 49/20;
(Continued)

(56) References Cited

U.S. PATENT DOCUMENTS 4,047,083 A 9/1977 Plunkett
5,915,883 A 6/1999 Kuehn
(Continued)

FOREIGN PATENT DOCUMENTS

CN 2739162 Y 11/2005
GB 2378483 A 2/2003
WO 2004114498 A2 12/2004

OTHER PUBLICATIONS

Sashidhar, S. et al; "A low-cost semi-modular dual-stack PM BLDC motor for a PV based bore-well submersible pump;" International Conference on Electrical Machines (ICEM), Sep. 2014.
(Continued)

*Primary Examiner* — Devon Kramer
*Assistant Examiner* — Kenneth J Hansen
(74) *Attorney, Agent, or Firm* — Pabitra K. Chakrabarti

(57) ABSTRACT

An electric submersible pump (ESP) control system includes a primary variable frequency drive (VFD), a transformer, and a secondary VFD. The primary variable frequency drive (VFD) is configured to receive power from a power source and output a variable voltage and variable amplitude AC voltage. The transformer has a low voltage side and a high voltage side of the transformer. The primary VFD is coupled to the low voltage side. The transformer is configured to receive the AC voltage from the primary VFD and output a stepped up AC voltage. The secondary VFD is coupled to the high voltage side of the transformer, wherein the secondary VFD is configured to provide a supplemental voltage in addition to the stepped up AC voltage when the operational values of an electric motor exceed a threshold value.

16 Claims, 7 Drawing Sheets

(51) Int. Cl.

| | |
|---|---|
| ***F04D 13/16*** | (2006.01) |
| ***F04D 29/22*** | (2006.01) |
| ***F04D 29/08*** | (2006.01) |
| ***F04D 29/42*** | (2006.01) |
| ***E21B 43/12*** | (2006.01) |

(52) U.S. Cl.
CPC ..... *F04D 13/16* (2013.01); *F04D 29/086* (2013.01); *F04D 29/22* (2013.01); *F04D 29/426* (2013.01)

(58) Field of Classification Search
CPC ..... F04B 2203/0201; F04B 2203/0202; E21B 43/128; H02J 3/46; H02M 3/335; H02M 3/33507; H02M 3/33538; H02M 3/33546
USPC ..... 307/80, 81, 85–87; 318/479, 500, 504; 361/23, 30, 31, 33, 92
See application file for complete search history.

(56) References Cited

U.S. PATENT DOCUMENTS

| | | | | |
|---|---|---|---|---|
| 6,242,884 | B1 | 6/2001 | Lipo et al. | |
| 6,531,842 | B2 | 3/2003 | LeDoux et al. | |
| 7,202,619 | B1 | 4/2007 | Fisher | |
| 8,314,583 | B2 * | 11/2012 | Yohanan | H02P 23/08 318/479 |
| 9,054,615 | B2 | 6/2015 | Head et al. | |
| 2001/0032721 | A1 * | 10/2001 | Rider | E21B 43/128 166/65.1 |
| 2009/0033251 | A1 | 2/2009 | Perisic et al. | |
| 2010/0330853 | A1 | 12/2010 | Bisht et al. | |
| 2011/0288703 | A1 | 11/2011 | Falkenstein et al. | |
| 2011/0304289 | A1 * | 12/2011 | Burdick | H02J 13/0096 318/400.3 |
| 2013/0175030 | A1 | 7/2013 | Ige et al. | |
| 2014/0158320 | A1 | 6/2014 | Archer et al. | |
| 2015/0097504 | A1 | 4/2015 | Lamascus et al. | |
| 2015/0114652 | A1 | 4/2015 | Lestz et al. | |
| 2016/0276970 | A1 | 9/2016 | Hawes et al. | |

OTHER PUBLICATIONS

Thangadurai et al; "Measurement of Turbulence Statistics Using Hot Wire Anemometry;" International Conference on Recent Trends in Engineering and Technology; Jul. 19, 2014.

International Search Report and Written Opinion issued in connection with corresponding PCT Application No. PCT/US2016/62655 dated Feb. 13, 2017.

* cited by examiner

DUAL MOTOR DRIVE FOR ELECTRIC SUBMERSIBLE PUMP SYSTEMS

BACKGROUND

The subject matter disclosed herein relates to variable frequency drives (VFDs), and more specifically to VFDs for driving electric machines used with electric submersible pumps (ESPs) in oil and gas applications.

In typical oil and gas drilling applications a well bore is drilled to reach a reservoir. The well bore may include multiple changes in direction and may have sections that are vertical, slanted, or horizontal. A well bore casing is inserted into the well bore to provide structure and support for the well bore. The oil, gas, or other fluid deposit is then pumped out of the reservoir, through the well bore casing, and to the surface, where it is collected. One way to pump the fluid from the reservoir to the surface is with an electrical submersible pump (ESP), which is driven by an electric motor (e.g., an induction motor or a permanent magnet motor) in the well bore casing.

A variety of components may be used to receive power from a power source, filter, convert and/or transform the power, and then drive the electric motor. For example, a variable frequency drive (VFD) may receive power from a power source (e.g., utility grid, batteries, a generator, etc.). The power may then pass through a filter and a step up transformer before being provided to the electric motor via a cable that passes through the well bore.

In some conditions (e.g., startup of a synchronous motor, seizure of the pump, transient load conditions, etc.), the motor may not operate as intended because magnetic saturation of the transformer prevents adequate voltage from reaching the motor. Accordingly, it may be desirable to improve the system to be capable of providing the motor with sufficient voltage to reduce or eliminate motor stalling.

BRIEF DESCRIPTION

Certain embodiments commensurate in scope with the original claims are summarized below. These embodiments are not intended to limit the scope of the claims, but rather these embodiments are intended only to provide a brief summary of possible forms of the claimed subject matter. Indeed, the claims may encompass a variety of forms that may be similar to or different from the embodiments set forth below.

In one embodiment, an electric submersible pump (ESP) control system includes a primary variable frequency drive (VFD), a transformer, and a secondary VFD. The primary variable frequency drive (VFD) is configured to receive power from a power source and output a variable voltage and variable amplitude AC voltage. The transformer has a low voltage side and a high voltage side of the transformer. The primary VFD is coupled to the low voltage side. The transformer is configured to receive the AC voltage from the primary VFD and output a stepped up AC voltage. The secondary VFD is coupled to the high voltage side of the transformer, wherein the secondary VFD is configured to provide a supplemental voltage in addition to the stepped up AC voltage when the operational values of an electric motor exceed a threshold value.

In a second embodiment, an ESP system includes a pump, an electric motor, and an ESP control system. The pump is configured to extract deposits from a reservoir. The electric motor is coupled to the pump, and is configured to receive an output voltage via a cable and drive the pump. The ESP control system includes a primary VFD, a transformer, and a secondary VFD. The VFD is configured to receive power from a power source and output a variable voltage and variable amplitude AC voltage. The transformer has a low voltage side and a high voltage side. The primary VFD is coupled to the low voltage side of the transformer. The transformer is configured to receive the AC voltage from the primary VFD and output a stepped up AC voltage. The secondary VFD coupled to the high voltage side of the transformer and is configured to provide a supplemental voltage in addition to supplement the stepped up AC voltage when the operational values of an electric motor exceed a threshold value. The stepped up AC voltage and the supplemental voltage combine to form the output voltage.

In a third embodiment, a method of controlling an ESP system includes monitoring one or more operational values of an electric motor in an ESP system, determining whether the one or more operational values of the electric motor are below a threshold value, and utilizing a secondary VFD when the one or more operational values of the motor exceed the threshold value.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Figure 1:
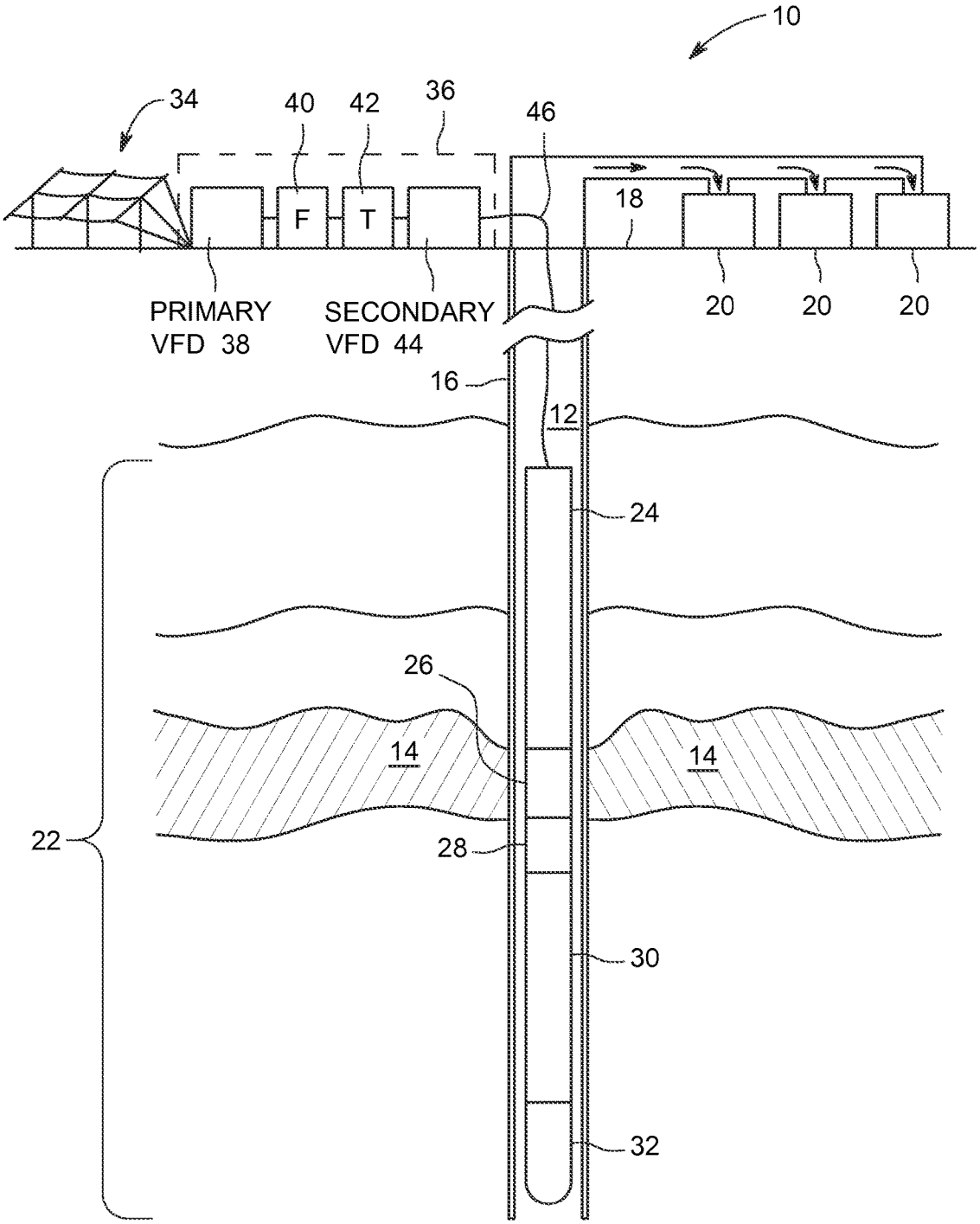
FIG. 1 is a schematic of a hydrocarbon extraction system extracting fluid from an underground reservoir in accordance with aspects of the present disclosure.

FIG. 1 is a schematic of a hydrocarbon extraction system (e.g., well 10) extracting fluid deposits (e.g., oil, gas, etc.) from an underground reservoir 14. As shown in FIG. 1, a well bore 12 may be drilled in the ground toward a fluid reservoir 14. Though the well bore 12 shown in FIG. 1 is a vertical well bore 12, well bores 12 may include several changes in direction and may include slanted or horizontal sections. A well bore casing 16 is typically inserted into the well bore 12 to provide support. Fluid deposits from the reservoir 14, may then be pumped to the surface 18 for collection in tanks 20, separation, and refining. Though there are many possible ways to pump fluids from an underground reservoir 14 to the surface 18, one technique is to use an electrical submersible pump (ESP), as shown in FIG. 1.

When using an ESP, an ESP assembly or system 22 is fed through the well bore casing 16 toward the reservoir 14. The ESP assembly 22 may include a pump 24, an intake 26, a sealing assembly 28, an electric motor 30, and a sensor 32. Power may be drawn from a power source 34 and provided to the electric motor 30 by an ESP control system 36. The power source 34 shown in FIG. 1 is a utility grid, but power may be provided in other ways (e.g., generator, batteries, etc.). The ESP control system 36 may include a primary variable frequency drive (VFD) 38, a filter 40, a transformer 42, a secondary VFD 44, and a cable 46. It should be understood, however, that FIG. 1 shows one embodiment, and that other embodiments may omit some elements or have additional elements. The primary VFD 38 synthesizes the variable frequency, variable amplitude, AC voltage that drives the motor. In some embodiments, the power output by the VFD may be filtered by filter 40. In the present embodiment, the filter 40 is a sine wave filter. However, in other embodiments, the filter may be a low pass filter, a band pass filter, or some other kind of filter. The power may then be stepped up or down by a transformer 42. In the present embodiment, a step up transformer is used for efficient transmission down the well bore 12 to the ESP assembly 22, however, other transformers or a plurality of transformers may be used. A secondary VFD 44 may be disposed on the high-voltage side of the transformer 42 and configured to deliver full-rated current for a short period of time (e.g., one minute or less) when the electric motor 30 requires more voltage than the transformer 42 can support. In embodiments with multiple transformers (e.g., a step up transformer 42 at the surface, and a step down transformer in the well bore 12, at the end of the cable 46, the secondary VFD 44 may be installed between the transformers or at the termination of the second transformer. Power output from the secondary VFD may be provided to the ESP assembly 22 via a cable 46 that is fed through the well bore casing 16 from the surface 18 to the ESP assembly 22. The motor 30 then draws power from the cable 46 to drive the pump 24. The motor 30 may be an induction motor, a permanent magnet motor, or any other type of electric motor.

The pump 24 may be a centrifugal pump with one or more stages. The intake 26 acts as a suction manifold, through which fluids 14 enter before proceeding to the pump 24. In some embodiments, the intake 26 may include a gas separator. A sealing assembly 28 may be disposed between the intake 26 and the motor 30. The sealing assembly protects the motor 30 from well fluids 14, transmits torque from the motor 30 to the pump 24, absorbs shaft thrust, and equalizes the pressure between the reservoir 14 and the motor 30. Additionally, the sealing assembly 28 may provide a chamber for the expansion and contraction of the motor oil resulting from the heating and cooling of the motor 30 during operation. The sealing assembly 28 may include labyrinth chambers, bag chambers, mechanical seals, or some combination thereof.

The sensor 32 is typically disposed at the base of the ESP assembly 22 and collects real-time system and well bore parameters. Sensed parameters may include pressure, temperature, motor winding temperature, vibration, current leakage, discharge pressure, and so forth. The sensor 32 may provide feedback to the ESP control system 36 and alert users when one or sensed parameters fall outside of expected ranges.

Figure 2:
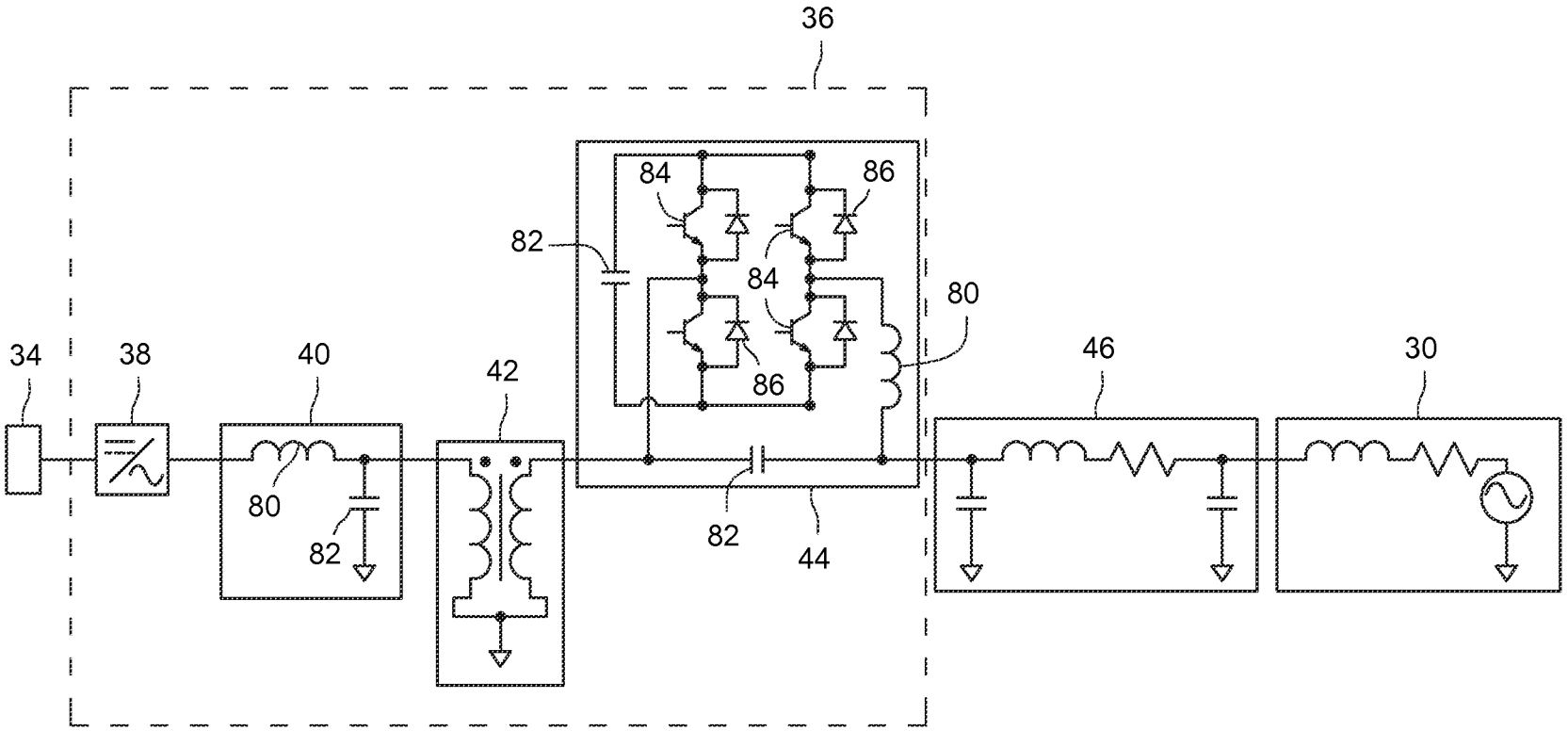
FIG. 2 is a wiring schematic of the electric submersible pump (ESP) control system in accordance with aspects of the present disclosure.

FIG. 2 is a wiring schematic of the ESP control system 36 shown in FIG. 1, in accordance with aspects of the present disclosure. As previously discussed, the primary VFD 38 receives power from a power source 34 (e.g., utility grid, battery, generator, etc.), modifies the power, and outputs a power signal of the desired frequency and amplitude for driving the electric motor 30. The primary VFD 38 may include power electronic switches, current measurement components, voltage measurements components, a process, or other components. The primary VFD 38 may be installed on the primary side of the transformer 42 and is programmed to operate the motor.

The output from the primary VFD 38 may then be filtered using the filter 40. In the embodiment shown, the filter 40 is a sine wave filter, however in other embodiments, the filter may be any low pass filter, or any other kind of filter. As shown in FIG. 2, the filter 40 may include inductors 80, capacitors 82, or other electrical components.

The output from the filter 40 is stepped up using the step up transformer 42. The step up transformer steps up the voltage of the power signal for efficient transmission through the cable 46 to the electric motor 30, which in some applications may as long as 1,000 to 10,000 feet. As will be discussed with regard to FIG. 5, because of magnetic saturation, the transformer 42 may be limited in the voltage it can supply to the electric motor 30 at low frequencies.

In order to deal with the limitations of the transformer, a secondary VFD 44 may be disposed in series or parallel with the line, on the high voltage secondary side of the transformer 42, and configured to deliver full rated current for short periods of time (e.g., less than 1 minute). The secondary VFD 44 may interface with only one or all three phases of the system 36. As shown in FIG. 2, the secondary VFD 44 may include transistors 84 (e.g., IGBT or MOSFET), diodes 86, inductors 80, capacitors 82, and any number of other components. The secondary VFD 44 may also include power electronic switches, current measurement components, voltage measurement components, a processor, control circuitry, and the like. In addition to the single phase H-bridge topology shown in FIG. 2, the secondary VFD 44 may have a single phase half-bridge topology, or a polyphase half-bridge topology. In addition to the series topology, a parallel topology may be employed.

In some situations that require the electric motor 30 to operate at low frequency with high torque (e.g., startup of a motor, a temporarily seized pump, a transient load condition, etc.), magnetic saturation may prevent the primary VFD 38 and the transformer 42 from providing sufficient voltage or magnetic flux to keep the electric motor 30 from stalling. Because the secondary VFD 44 is on the high voltage side of the transformer, the secondary VFD 44 can provide full rated current for a short period of time (e.g., one minute or less), thus supplementing the voltage of the primary VFD 38 until the motor 30 reaches a high enough frequency for the primary VFD 38 to drive the motor 30 on its own. Motor 30 requirements (e.g., operational values, operational parameters, or parameters to drive the pump 24) and magnetic saturation of the transformer 42 will be discussed in more detail with regard to FIG. 5. As previously discussed, the power signal output by the ESP control system 36 is transmitted to the electric motor 30 via the cable 46.

Figure 3:
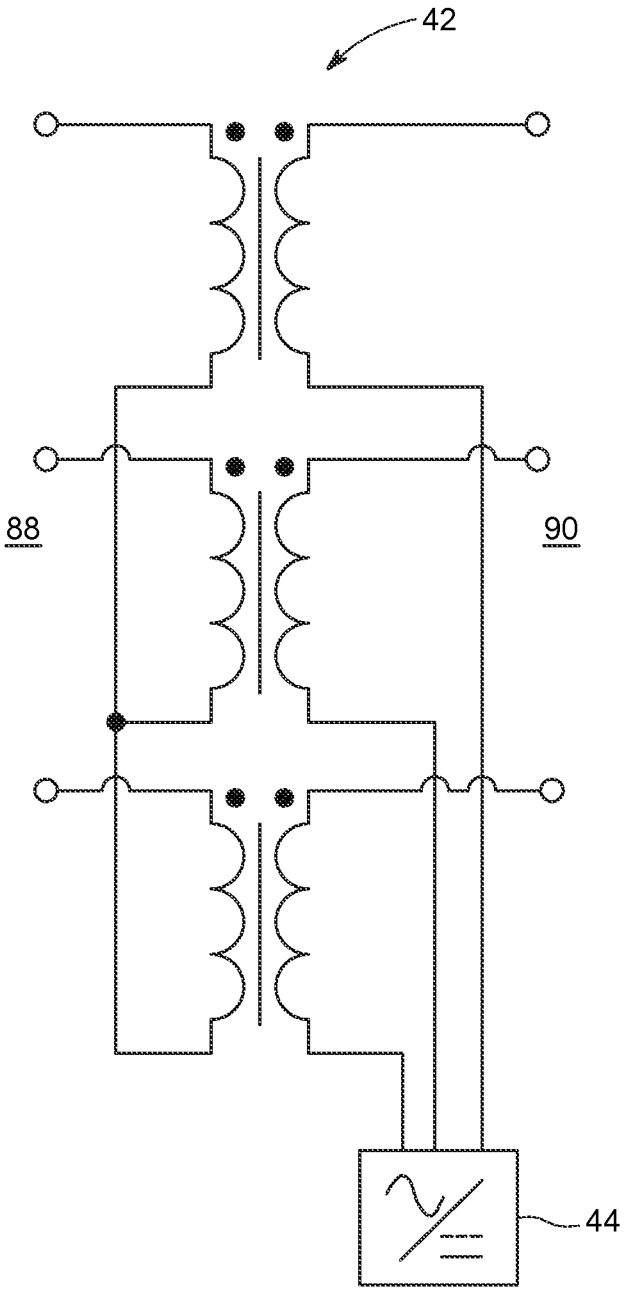
FIG. 3 is a wiring schematic showing an alternative embodiment of coupling the secondary variable frequency drive (VFD) to a high voltage side of a transformer in accordance with aspects of the present disclosure.
Figure 4:
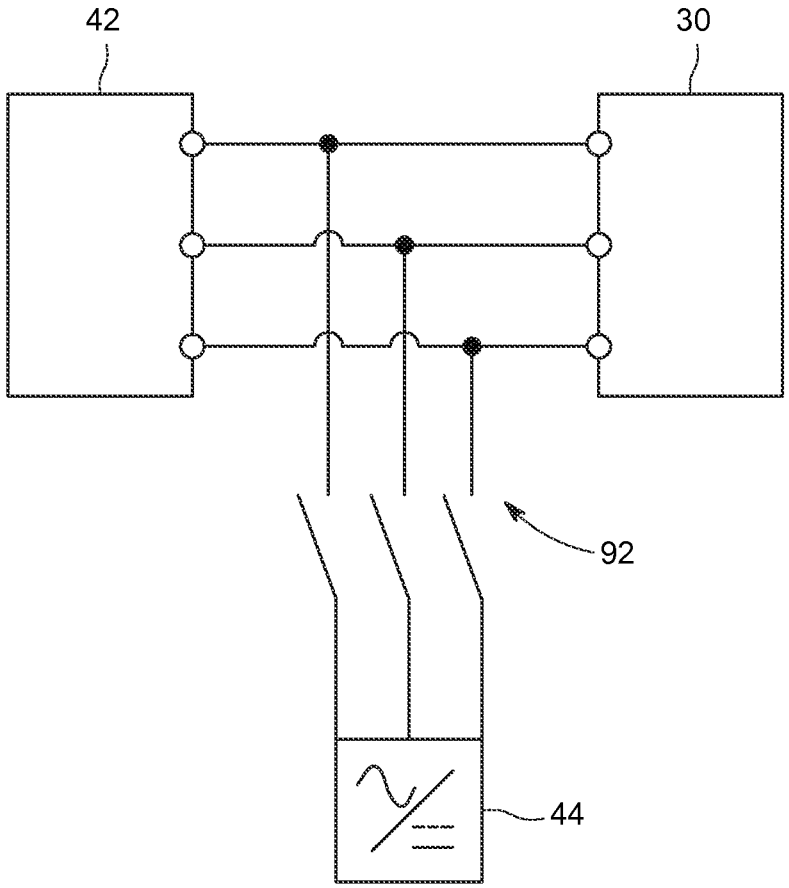
FIG. 4 is a wiring schematic showing an alternative embodiment of coupling the secondary variable frequency drive (VFD) to the transformer using switches in accordance with aspects of the present disclosure.

FIGS. 3 and 4 are wiring schematics of alternative embodiments of coupling the secondary VFD 44 to the transformer 42. Specifically, FIG. 3 is a wiring schematic showing an alternative embodiment of coupling the secondary VFD 44 to a high voltage side 90 of the transformer 42. As shown, the transformer 42 has a low voltage side 88 and a high voltage side 90. The transformer 42 receives a voltage at the low voltage side 88, "steps up" the voltage, and outputs the stepped up voltage at the high voltage side 90. In the embodiment shown in FIG. 3, the low voltage side 88 is shown in Y, but could also be in delta. FIG. 4 is a wiring schematic showing an alternative embodiment of coupling the secondary VFD 44 to the transformer 42 using switches 92. As shown in FIG. 4, the secondary VFD 44 is coupled between the transformer 42 and the electric motor by three lines, each corresponding to a phase of the voltage signal. Each of the three lines may include respective switches 92. Though three phases are shown, it should be understood that a different number of phases may be possible. In such a configuration, the number of switches may or may not correspond to the number of phases.

Figure 5:
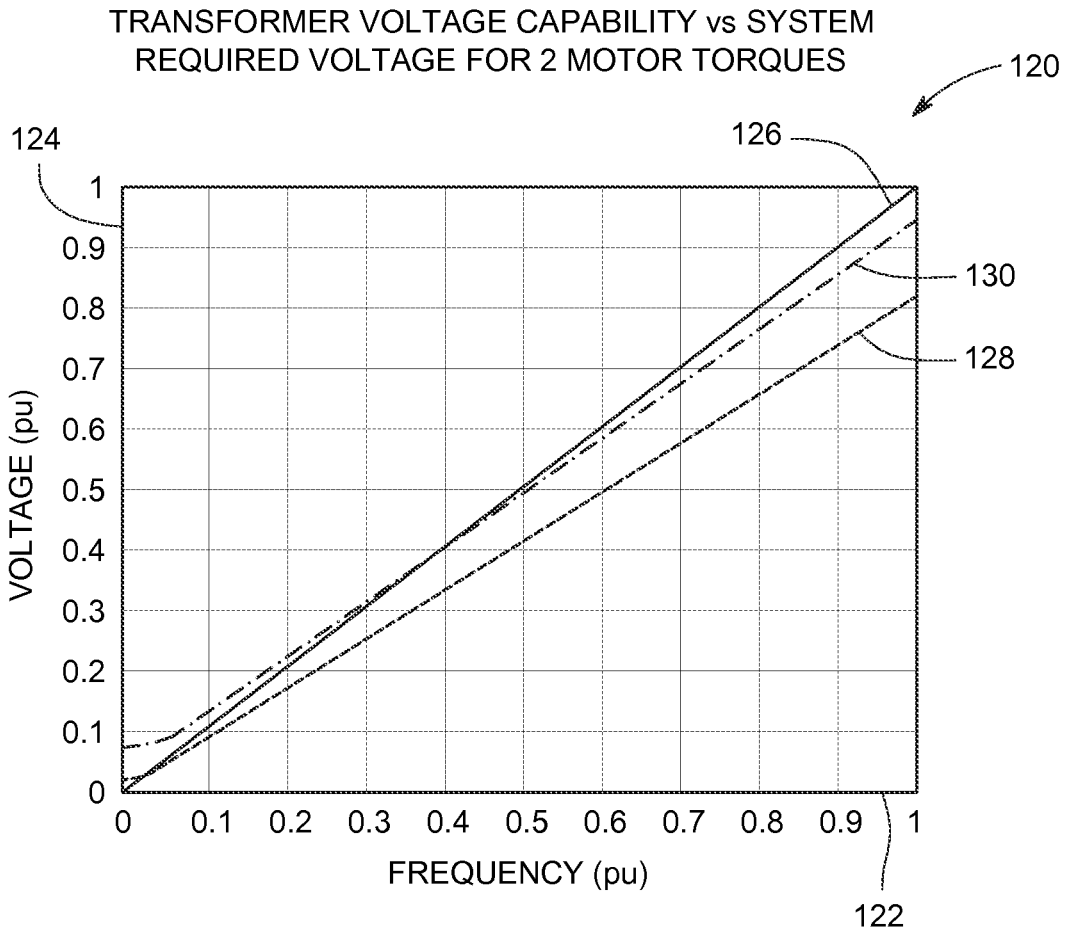
FIG. 5 is a plot of transformer voltage capability versus system required voltage for two synchronous motor torques.

FIG. 5 is a plot 120 of transformer 42 voltage capability versus system required voltage for two synchronous motor 30 torques. The x-axis 122 represents per-unit frequency (e.g., a percent of capability) and the y-axis 124 represents normalized voltage (e.g., a percent of capability). Line 126, which has a slope of 1.0 and an intercept of 0.0, represents the maximum operating conditions of the transformer 42. Lines 128 and 130 represent the voltage requirements of a prototypical synchronous motor 30 while supporting 25% and 75% rated torque, respectively. Due to magnetic saturation, the transformer 42 must operate below line 126. At most frequencies, (e.g., higher than about 20% per unit frequency on the x-axis 122), the voltage requirements of the motor 30 are below the maximum operating conditions of the transformer 42, meaning that powering the motor 30 is within the capabilities of the transformer 42 and the primary VFD 38. However, at the low end of the frequency range (e.g., less than 10% or 20% per unit frequency on the x-axis), the voltages required to operate the motor 30 exceed the capabilities of the transformer 42 and the primary VFD 38. Without the assistance of the secondary VFD 44, situations that require high torque at low frequency (e.g., startup of a motor 30, seizure of the pump 24, transient load conditions, etc.) may result in the motor 30 stalling. When the capabilities of the transformer 42 are approached or exceeded by the requirements (e.g., operational values, operational parameters, or parameters to drive the pump 24) of the motor 30 (e.g., a threshold value is exceeded), the secondary VFD 44 may provide full rated power for a short period of time (e.g., less than one minute) to supplement the primary VFD 38 and the transformer 42.

Figure 6:
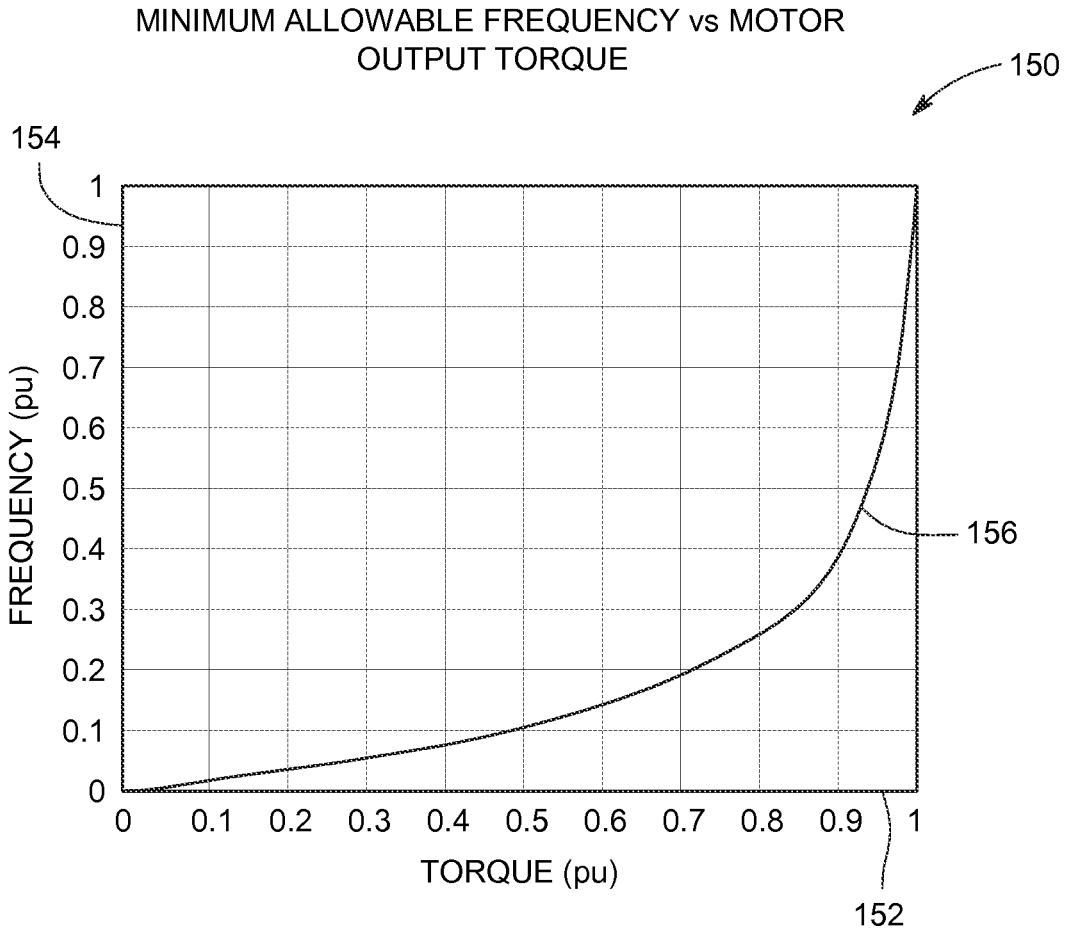
FIG. 6 is a plot of the minimum allowable operating frequency of the system as a function of motor output torque.

FIG. 6 is a plot 150 of the minimum allowable operating frequency 154 of the system as a function of motor output torque 152. The x-axis represents the per-unit torque (e.g., a percent of capability) and the y-axis represents the per-unit frequency (e.g., a percent of capability). A system with a single VFD 38 (e.g., a system without a secondary VFD 44) must operate above line 156, which represents the minimum allowable operating frequency. Accordingly, an ESP control system 36 without a secondary VFD 44 will likely be unable to drive the motor 30 at low frequencies and high torques (e.g., 20% frequency and 80% torque). For example, starting a synchronous AC motor 30 requires high torque at low frequency. The addition of a secondary VFD 44 effectively increases the starting torque of the system 36 by providing full rated power for a short period of time. In operation, the secondary VFD 44 may start the motor 30 at full torque. Once the frequency increases and/or the voltage requirement of the motor decreases to within the capabilities of the primary VFD 38 and the transformer 42, the primary VFD 38 and the transformer 42 takeover driving the motor 30.

Figure 7:
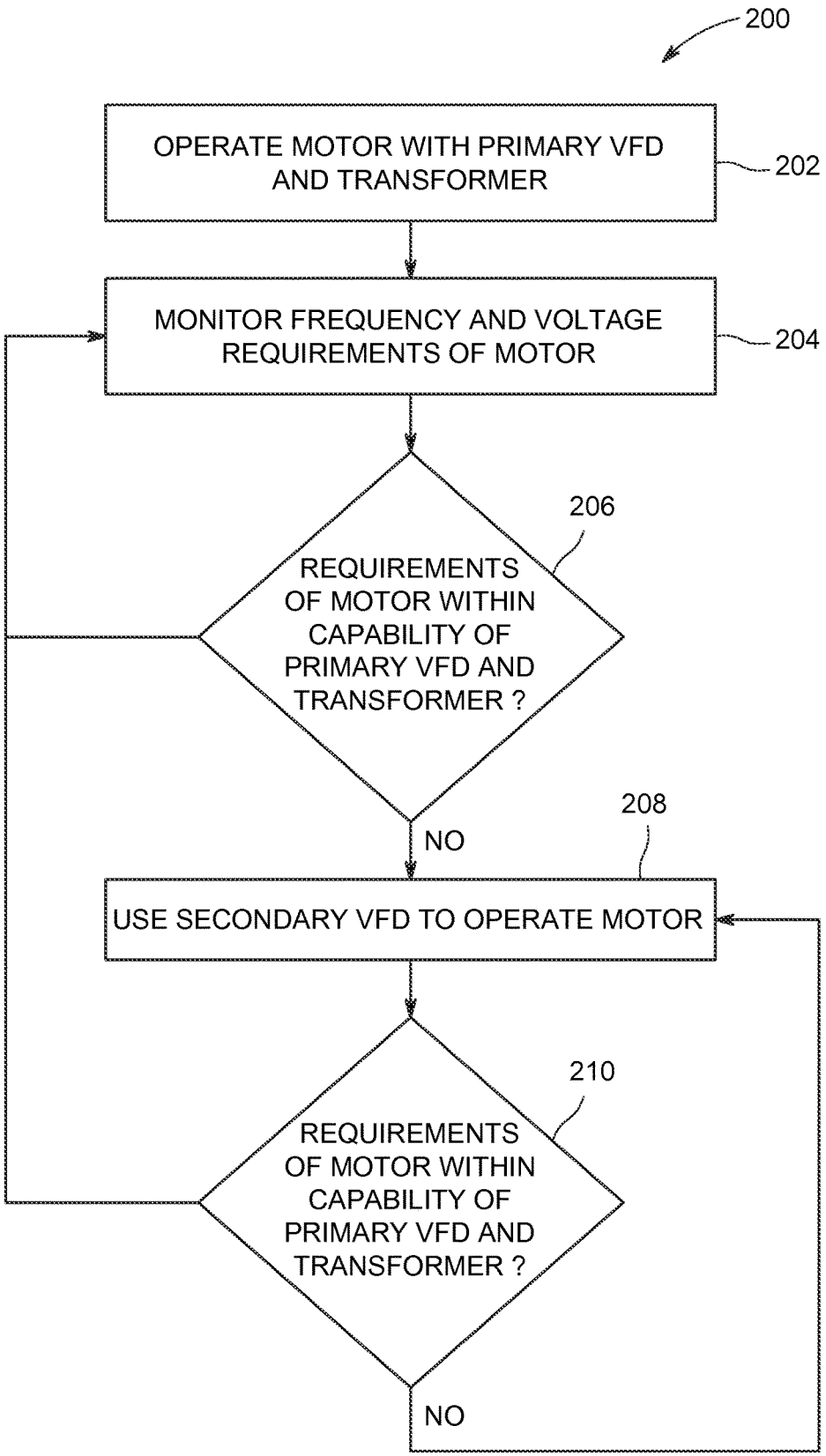
FIG. 7 is a flow chart for a process of operating a system with two variable frequency drives (VFDs) in accordance with aspects of the present disclosure.

FIG. 7 is a flow chart for a process 200 of operating a system 10 with two VFDs (38, 44). In block 202, the process 200 operates the electric motor 30 using the primary VFD 38 and the transformer 42. In block 202, the secondary VFD 44 may not provide any power to the motor 30, or may provide a nominal amount of power to the motor 30 in comparison to the primary VFD 38 and the transformer 42. In some embodiments, the motor 30 may be in a steady state or near steady state in block 202. Referring back to plot 120 shown in FIG. 5, in block 202, the motor 30 is likely operating at a voltage and frequency below line 126. In block 204, the process 200 monitors the requirements (e.g., operational values, operational parameters, or parameters to drive the pump 24) of the motor 30. For example, the process 200 may monitor the frequency, voltage, and/or torque requirements of the motor.

At decision 206, the process 200 determines whether the requirements of the motor 30 monitored in block 204 are within the capability of the primary VFD 38 and the transformer 42 (e.g., whether the requirements of the motor 30 monitored in block 204 are below a threshold value). For example, as discussed with regard to FIG. 5, the process 200 may monitor the voltage and frequency requirements of the motor 30 and determine whether the required combination of voltage and frequency fall below line 126. Similarly, as discussed with regard to FIG. 6, the process 200 may monitor the frequency and torque requirements of the motor 30 and determine whether the required combination of voltage and frequency fall above line 156.

In decision 206, if the requirements of the motor fall well within the capability of the primary VFD 38 and the transformer 42 (e.g., the requirements of the motor 30 are below a threshold value), the process will continue to operate the motor 30 with the primary VFD 38 and return to block 204, monitoring the requirements of the motor 30. In block 208, if the requirements of the motor 30 approach or exceed the capability of the primary VFD 38 and transformer 42, the process 200 may utilize the secondary VFD 44 to provide additional power (e.g., voltage, magnetic flux, etc.) in order to reduce the likelihood of the motor 30 stalling. As previously discussed, conditions in which the process 200 may utilize the secondary VFD 44 may include startup of a synchronous motor 30, seizure of the pump 24, transient load conditions, and the like. The process 200 may continue to monitor the requirements of the motor.

In decision 210, if the requirements of the motor approach or exceed the capability of the primary VFD 38 and the transformer 42 (e.g., the requirements of the motor 30 are above a threshold value), the process continues to utilize the secondary VFD 44 to drive the motor 30. If the requirements of the motor 30 are within the capabilities of the primary VFD 38 and the transformer 42 (e.g., the requirements of the motor 30 are below a threshold value), the process 200 may return to block 204, operating the motor 30 with the primary VFD 38 and monitoring the requirements of the motor 30.

As the oil reservoir 14 is depleted, the torque, voltage, and frequency requirements of the motor 30 may be reduced. In such cases, it may be possible to remove the primary VFD 38, relying only on the secondary VFD 44 to drive the motor 30.

Technical effects of the disclosure include use of a secondary VFD 44 on the high voltage side of the transformer 42 that provides supplemental power (e.g., magnetic flux, voltage, etc.) when the requirements of the electric motor 30 approach or exceed the capabilities of the primary VFD 38 and the transformer 42. The disclosed techniques may be used to provide short bursts of power to an electric motor 30 when the demands of the motor 30 exceed those of the primary VFD 38 and transformer 42 (e.g., startup of a synchronous motor, seizure of the pump, transient load conditions, and the like).

This written description uses examples to disclose the subject matter, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An electric submersible pump (ESP) control system comprising:

a primary variable frequency drive (VFD) configured to receive power from a power source and output a variable voltage and variable amplitude AC voltage;

a transformer comprising a low voltage side and a high voltage side of the transformer, wherein the primary VFD is coupled to the low voltage side, and wherein the transformer is configured to receive the AC voltage from the primary VFD and output a stepped up AC voltage; and a secondary VFD coupled to the high voltage side of the transformer, wherein the secondary VFD is configured to provide a supplemental voltage in addition to the stepped up AC voltage when operational values of an electric motor exceed a threshold value.

2. The ESP control system of claim 1, wherein the secondary VFD is configured to provide additional voltage in order to prevent one or more of the motor from stalling during startup of the motor, seizure of an electric submersible pum, or transient load conditions for the motor.

3. The ESP control system of claim 2, wherein the motor is a synchronous motor.

4. The ESP control system of claim 3, wherein the motor is a permanent magnet motor.

5. The ESP control system of claim 1, wherein the secondary VFD is configured to provide the supplemental voltage for a period of less than 1 minute.

6. The ESP control system of claim 1, wherein the primary and secondary VFDs comprise power electronic switches, current measurement components, voltage measurement components, and a processor.

7. The ESP control system of claim 1, comprising a low pass filter coupled between the primary VFD and the low voltage side of the transformer.

8. The ESP control system of claim 1, wherein the secondary VFD is installed in series or parallel with the primary VFD.

9. An ESP system comprising:

a pump configured to extract deposits from a reservoir;

an electric motor coupled to the pump, wherein the electric motor is configured to receive an output voltage via a cable and drive the pump; and an ESP control system comprising:

a primary variable frequency drive (VFD) configured to receive power from a power source and output a variable voltage and variable amplitude AC voltage;

a transformer comprising a low voltage side and a high voltage side, wherein the primary VFD is coupled to the low voltage side of the transformer, and wherein the transformer is configured to receive the AC voltage from the primary VFD and output a stepped up AC voltage; and a secondary VFD coupled to the high voltage side of the transformer, wherein the secondary VFD is configured to provide a supplemental voltage in addition to supplement the stepped up AC voltage when operational values of an electric motor exceed a threshold value, wherein the stepped up AC voltage and the supplemental voltage combine to form the output voltage.

10. The ESP system of claim 9, comprising:

an intake coupled to the pump through which deposits pass before entering the pump;

a sealing assembly disposed between the intake and the electric motor, configured to protect the electric motor from the deposits; and a sensor coupled to the electric motor and configured to collect real-time system parameters and well bore parameters and communicate the collected parameters to the ESP control system via the cable.

11. The ESP system of claim 9, wherein the electric motor is a synchronous motor.

12. The ESP system of claim 11, wherein the electric motor is a permanent magnet motor.

13. The ESP system of claim 9, wherein the secondary VFD is configured to provide the supplemental voltage for a period of less than 1 minute.

14. The ESP system of claim 9, wherein the primary and secondary VFDs comprise power electronic switches, current measurement components, voltage measurement components, and a processor.

15. The ESP system of claim 9, wherein the power source is a utility grid, a battery, or a generator.

16. The ESP system of claim 9, comprising a sine wave filter disposed between the primary VFD and the transformer.

* * * * *